United States Patent [19]

Yamamoto et al.

[11] Patent Number: 4,615,204

[45] Date of Patent: Oct. 7, 1986

[54] DRAWING APPARATUS OF THE DOUBLE ACTION AND LOWER PUNCH SLIDE TYPE

[75] Inventors: Takeshi Yamamoto, Yukuhashi; Tadashi Furubayashi, Kitakyushu; Masanobu Igami, Fukuoka; Tsutomu Hashino, Kitakyushu, all of Japan

[73] Assignee: Nissan Motor Company, Ltd., Japan

[21] Appl. No.: 678,488

[22] Filed: Dec. 5, 1984

[30] Foreign Application Priority Data

Dec. 28, 1983 [JP] Japan ..... 58-246722

[51] Int. Cl.[4] ..... B21D 22/00

[52] U.S. Cl. ..... 72/347; 72/354; 72/456; 100/269 R

[58] Field of Search ..... 72/448, 446, 455, 456, 72/352, 354, 347, 348; 100/DIG. 18, 214, 269 R

[56] References Cited

U.S. PATENT DOCUMENTS

| | | | |
|---|---|---|---|
| 1,768,504 | 6/1930 | Byerlein | 72/448 |
| 2,102,842 | 12/1937 | Glasner | 72/448 |
| 2,248,186 | 7/1941 | Oeckl | 72/466 |
| 2,975,701 | 3/1961 | Menschaeur | 72/448 |
| 3,673,849 | 7/1972 | Bogdan | 72/453 |

*Primary Examiner*—Leon Gilden

*Attorney, Agent, or Firm*—Lowe, Price, LeBlanc Becker & Shur

[57] ABSTRACT

In a drawing apparatus of the type in which a lower punch slide moves upward to draw a blank clamped between a movable die and a stationary blank holder, an adjustable ram is provided which is electrically driven to move upward and downward for thereby adjusting the bottom dead position of the punch so that the upper end of the punch is made substantially flush with the upper end surface of the blank holder when the punch is in its bottom dead position.

10 Claims, 7 Drawing Figures

DRAWING APPARATUS OF THE DOUBLE ACTION AND LOWER PUNCH SLIDE TYPE

BACKGROUND OF THE INVENTION

1. Field of the Invention

The present invention relates to a drawing apparatus consisting of a drawing die assembly and a double action mechanical press of the type having a fixed blank holder table, an upper die slide and a lower punch slide (herein referred to as a lower punch slide type double action press).

2. Description of the Prior Art

A double action press is suited for performing a drawing process of a pressed part as is well known in the art. However, when an ordinary double action press is utilized in combination with a transfer press for the following processes of the pressed part, it may cause a problem that the part drawn thereby needs to be turned over before fed to the transfer press. In that case, the aforementioned lower punch slide type double action press is utilized to eliminate the turn-over process.

FIGS. 1 and 2 show a prior art drawing apparatus 10 of the double action and lower punch slide type. The drawing aparatus 10 consists of a drawing die assembly 12 and a lower punch slide type double action press 14. The lower punch slide type double action press 14 includes a fixed blank holder table or bolster 16 mounted on a bed 18, an upper die slide 20 and a lower punch slide 22. The blank holder table 16 is formed with a stepped hole **16*a* for allowing the lower punch slide 22 to come thereinto upon an upward stroke of same. The stepped hole 16*a* has a shoulder 16*b*. The drawing die assembly 12 includes a blank holder 24 fixedly mounted on the table 16 by way of a blank holder plate 26, a die 28 mounted on the upper slide 20 and a punch 30 movably guided by the blank holder 24 and fixedly attached to a punch plate 32 which is in turn supported on the shoulder 16*b* of the blank holder table 16. Indicated by the reference numeral 34 are a plurality of shims placed between the punch plate 32 and the shoulder 16*b* for the adjustment of the bottom dead position of the punch 30 (i.e. the position which the punch 30 assumes when disengaged from the lower punch slide 22**).

In operation, a blank W is first placed on the blank holder 24. The upper die slide 20 is then caused to come down to a position where the blank W is clamped between the die 28 and the blank holder 24. The upper die slide 20 remains at that position for a while during which the lower punch slide 22 having come in contact with the punch plate 32 further moves upward to cause the punch 30 to protrude into the die 28 for thereby drawing the blank W into a predetermined shape as shown in FIG. 2.

In the foregoing prior art drawing apparatus, the shims 34 are in effect indispensable for making the upper end of the punch 30 nearly flush with the upper end surface of the blank holder 24 so that the blank W is held not only by the blank holder 24 but by the upper end of the punch 30 when supplied to the drawing die assembly 14. If the upper end of the punch 30 is not flush with, e.g. considerably lower than the upper end surface of the blank holder 24, such a case may occur in which the blank W is curved too much to be subject to a proper drawing operation. This is particularly true when the blank W is considerably large relative to its thickness and the article to be drawn from the blank W is relatively shallow. The setting of the shims 34 however is quite laborious since adjustement of the shims 34 requires removal of the punch 30 and the blank holder 24. Furthermore, a different drawing die assembly requires a different set of shims, making the die setting operation more laborious.

SUMMARY OF THE INVENTION

In accordance with the present invention, an improved drawing apparatus is provided which comprises as usual a drawing die assembly and a lower punch slide type double action press. The drawing die assembly comprises a die, a blank holder and a punch. The double action press has an upper die slide mounting thereon the die, a bolster mounting thereon the blank holder and a lower punch slide mounting thereon the punch.

In accordance with the present invention, the drawing apparatus is provided with a power operated punch supporting device adjustably supporting the punch on the bolster when the punch is in its bottom dead position. The punch supporting device comprises an adjusting ram on which is supported the punch in its bottom dead position and a drive unit through which the adjusting ram is power operated to move upward and downward for changing the bottom dead position of the punch.

The above structure is quite effective for overcoming the above noted disadvantages and shortcomings inherent in the prior art apparatus.

It is accordingly an object of the present invention to provide an improved drawing apparatus of the double action and lower punch slide type facilitating adjustment of the upper end of a punch in its bottom dead position so as to be substantially flush with the upper end surface of a blank holder.

It is another object of the present invention to provide an improved drawing apparatus of the above mentioned character which can considerably reduce the intensity of a die setting work.

It is a further object of the present invention to provide an improved drawing apparatus of the above mentioned character which can considerably shorten the time required for the die setting work.

It is a yet further object of the present invention to provide an improved drawing apparatus of the above mentioned character which can reduce the noise and vibration resulting from its drawing operation.

It is a yet further object of the present invention to provide an improved drawing apparatus of the above mentioned character which can improve the quality of an article produced thereby.

BRIEF DESCRIPTION OF THE DRAWINGS

The features and advantages of the drawing apparatus according to the present invention will become more clearly appreciated from the following description taken in conjunction with the accompanying drawings, in which.

DETAILED DESCRIPTION OF THE PREFERRED EMBODIMENT

Figure 1:
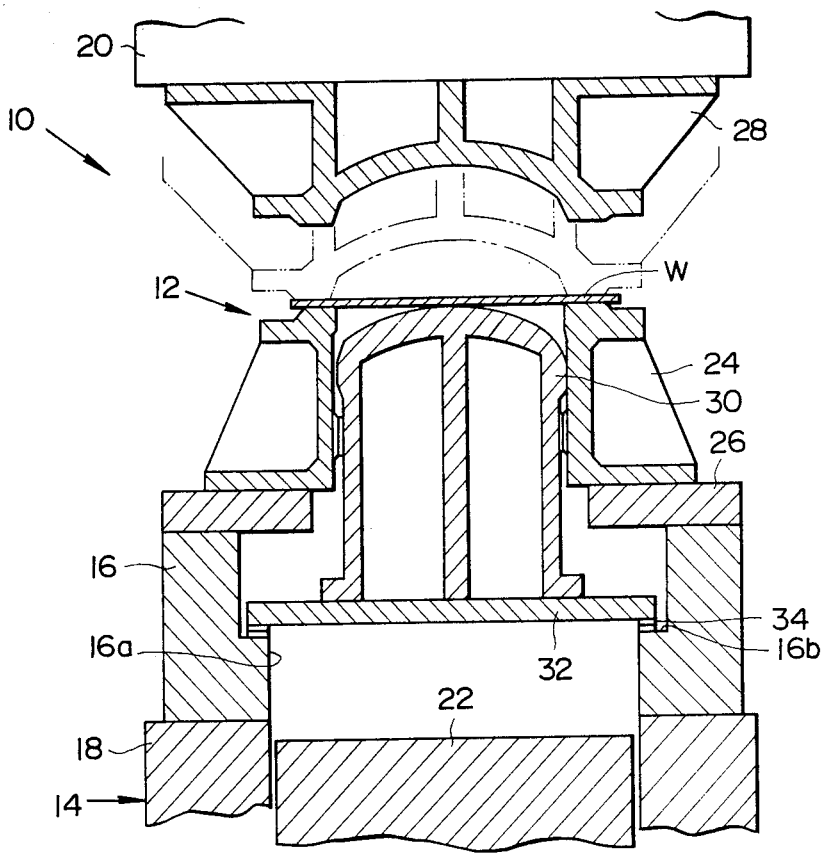
FIG.1 (PRIOR ART)
FIG. 1 is a sectional view of a prior art drawing apparatus of the double action and lower punch slide type in its fully open position.
Figure 2:
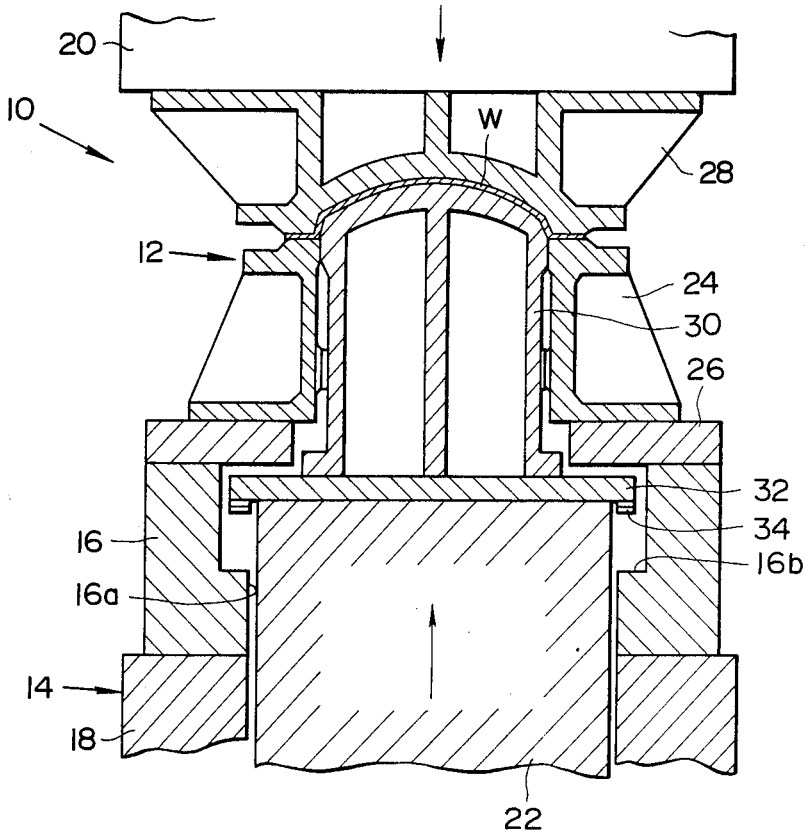
FIG.2 (PRIOR ART)
FIG. 2 is a view similar to FIG. 1 but showing the drawing apparatus of FIG. 1 in its fully closed position.

Referring to FIGS. 3 to 6, in which like or corresponding parts to those of the prior art drawing apparatus of FIGS. 1 and 2 are designated by the same reference numerals as their corresponding parts, a drawing apparatus 36 according to an embodiment of the present invention comprises a rectangular bolster 38, a power operated bolster supporting device 40 adjustably supporting the bolster 38 on the bed 18, and a power operated punch supporting device 42 adjustably supporting the punch 30 on the bolster 38.

The bolster 38 has an upper rectangular plate section 38*a* formed with a rectangular opening 38*b* so as not to obstruct movement of the punch 30. A hollow rectangular vertical wall section 38*c* extends downwardly from the inner periphery of the upper rectangular plate section 38*a*, and an inward flange section 38*d* extends horizontally and inwardly from the lower end of the vertical wall section 38*c* in a manner not to obstruct movement of the lower punch slide 22.

The bolster supporting device 40 comprises a plurality of extendible and contractible post units 44 fixedly attached at the upper and lower ends to the bolster 38 and the bed 18, respectively. In this embodiment, four post units 44 are provided to support the respective corner portions of the upper rectangular plate section 38*a* on the bed 18. Each post unit 44 consists of a hollow outer post member 46 and an inner threaded post member 48 which are concentrically joined together in such a manner that the inner post member 48 is movable into or out of the outer post member 46 to shorten or lengthen the post unit 44. To this end, a nut 50 is mounted in the outer post member 46 for rotation but against axial movement and screwed onto the inner post member 48. The nut 50 has a toothed outer periphery and is engaged thereat with a worm gear 52 so that rotation of the worm gear 52 causes the nut 50 to rotate, which nut 50 in turn causes the inner post member 48 to move axially relative to the outer post member 46.

Figure 6:
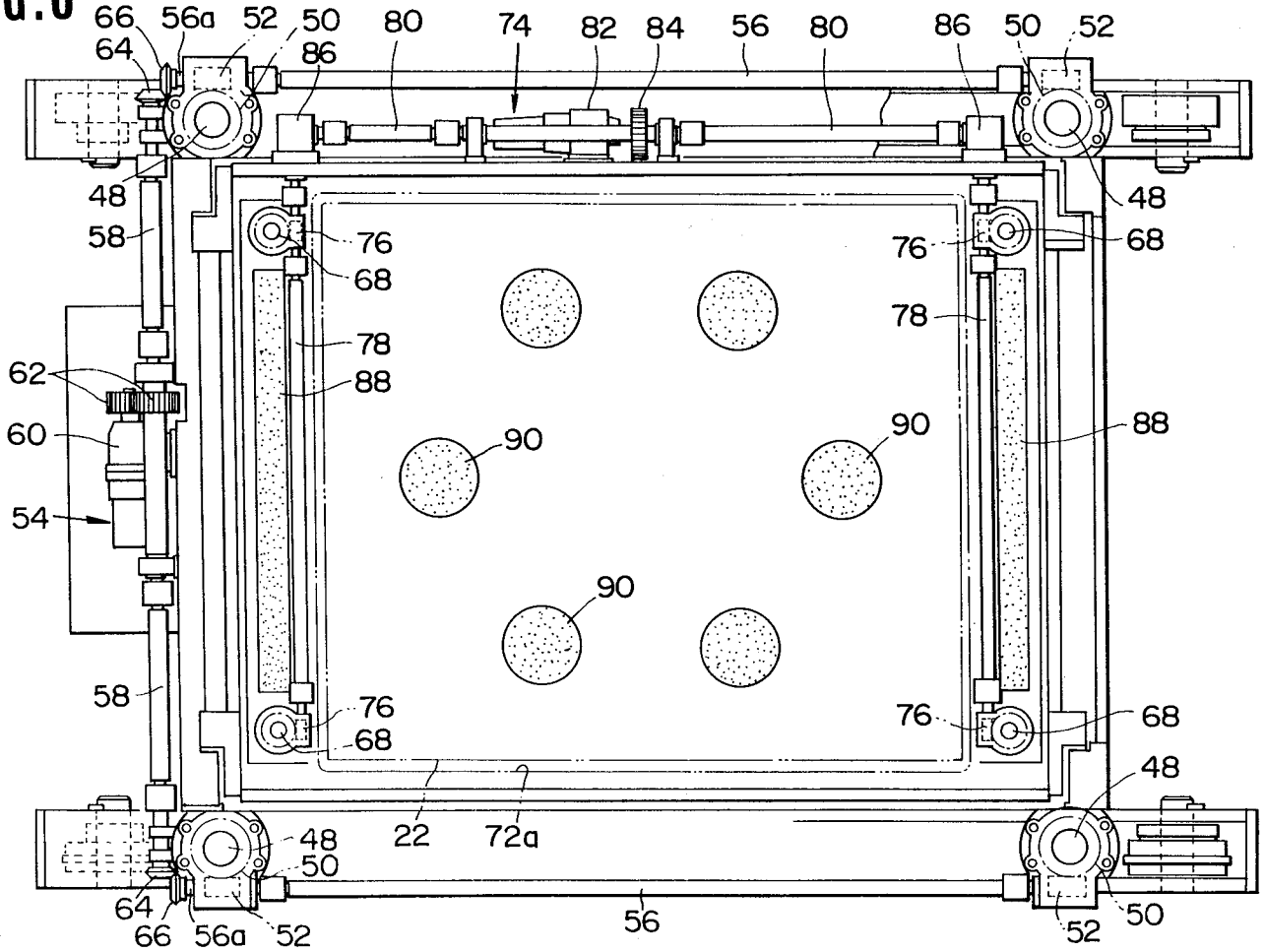
FIG. 6 is a plan view of the novel main portion of the drawing apparatus of FIG. 5.

The post units 44 are adapted to be driven by an electric drive unit 54 as shown in FIG. 6. The drive unit 54 includes two connecting shafts 56 disposed in parallel relation to each other and drivingly interconnecting the respective pairs of worm gears 52 in a manner to have corresponding one ends 56*a* extended beyond the worm gears 52, a drive shaft 58 disposed in perpendicular relation to the connecting shafts 58 and extending between the worm gears 52 to which the foregoing ends 56*a* of the connecting shafts 56 are connected, an electric motor 60, a reduction gearing 62 drivingly interconnecting the drive shaft 58 and the electric motor 60 and two pairs of drivingly-coupled bevel gears 64 and 66, one 64 of which is connected to an end of the drive shaft 58 and the other 66 of which is connected to the foregoing one ends 56*a* of the connecting shafts 56. By the above drive unit 54, the post units 44 can be electrically driven to extend or contract synchronously for thereby changing the position of the bolster 38 relative to the bed 18.

The punch supporting device 42 comprises four threaded vertical posts 68 rotatably supported at the upper and lower ends thereof on the inward flange section 38*d* of the bolster 38 and the upper plate section 38*a* of same, a rectangular floating ram 70 removably attached to the lower end of the punch 30 by means of a suitable clamp means, and a rectangular adjusting ram 72 mounting thereon the floating ram 70 and having adjacent its corner portions four threaded holes 72*b* at which it is screwed onto or threadedly mounted on the threaded posts 68. The adjusting ram 72 is hollow or a frame-like member and has a rectangular opening 72*a* (refer to FIG. 6) for allowing the lower punch slide 22 to pass therethrough upon upward movement of same. The threaded posts 68 are disposed adjacent the corner portions of the inward flange section 38*d* of the bolster 38 and therefore adjacent the post units 44. The floating ram 70 are cut at the corner portions so as not to engage the threaded posts 68.

As shown in FIG. 6, the threaded posts 68 are adapted to be electrically driven by a drive unit 74. The drive unit 74 includes four worm gears 76 respectively engaged with the threaded posts 68, two connecting shafts 78 disposed in parallel relation to each other (also in parallel relation to the connecting shaft 56) and drivingly interconnecting the respective pairs of worm gears 76 in a manner to have corresponding one ends 78*a* extended beyond the worm gears 76, a drive shaft 80 disposed in perpendicular relation to the connecting shafts 78 and extending between the worm gears 76 to which the foregoing one ends 78*a* of the connecting shafts 78 are connected, an electric motor 82, a reduction gearing 84 drivingly interconnecting the drive shaft 80 and the electric motor 82 and two couplings 86 such as the type including two bevel gears, drivingly interconnecting the drive shaft 80 and the connecting shafts 78. By the above drive unit 74, the threaded posts 68 can be electrically driven synchronously to cause the adjusting ram 72 to move upward or downward for thereby changing the bottom dead position of the punch 30 relative to the bed 18 or to the blank holder 24.

Indicated by the reference numeral 88 are two elongated shock absorbing members made of urethane and attached to the upper surface of the adjusting ram 72, and by 90 are the similar shock absorbing members made of urethane and formed into a circular shape and attached to the lower surface of the floating ram 70.

Figure 3:
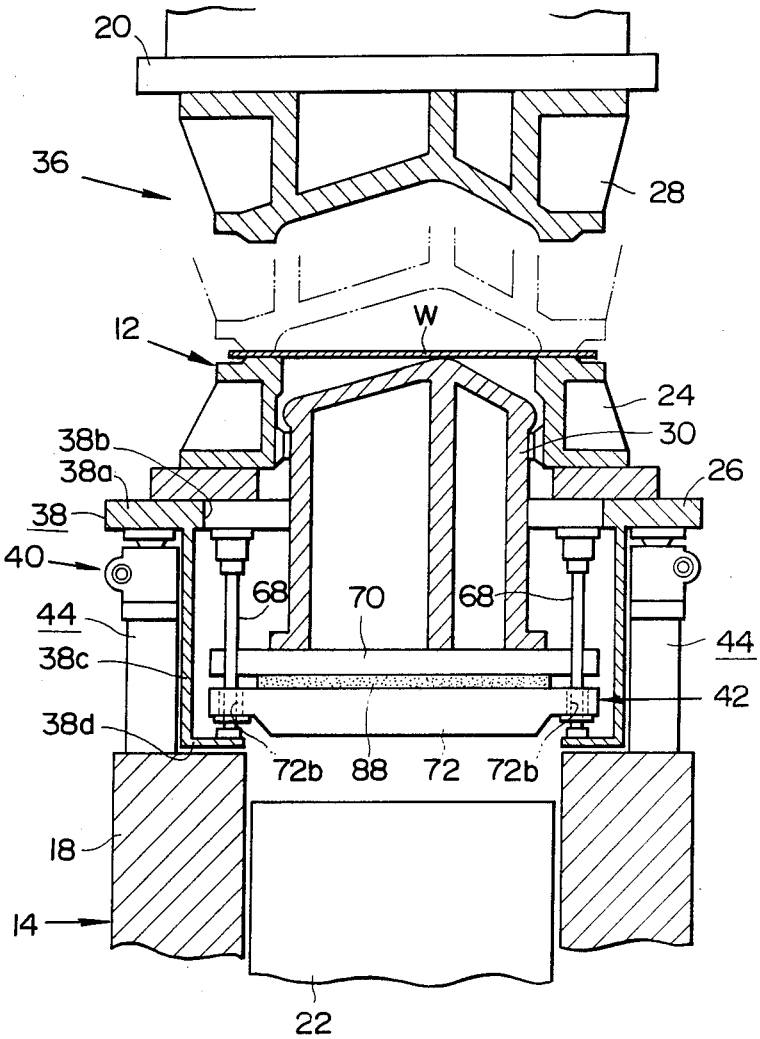
FIG. 3. is a view similar to FIG. 1 but showing a drawing apparatus according to an embodiment of the present invention in its fully open position.
Figure 4:
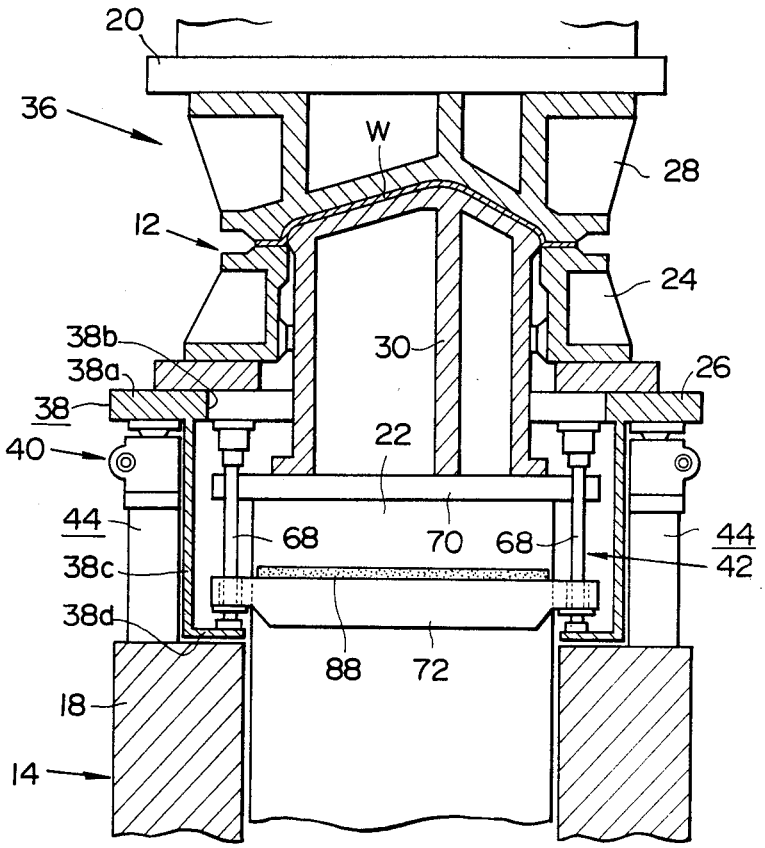
FIG. 4 is a view similar to FIG. 3 but showing the drawing apparatus of FIG. 3 in its fully closed position.
Figure 5:
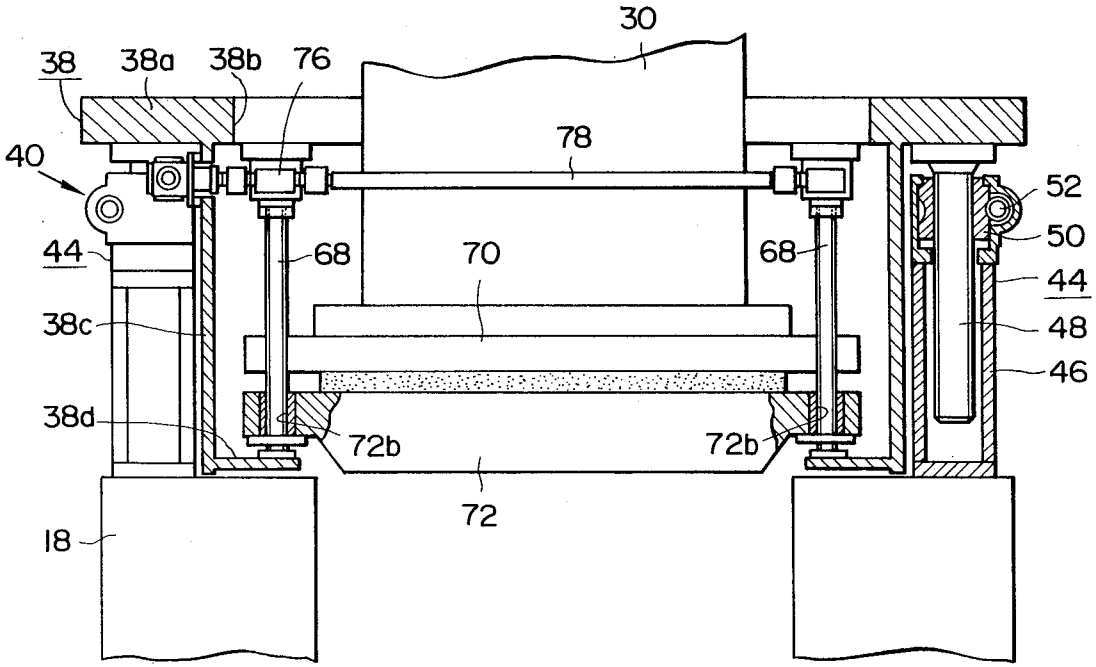
FIG. 5 is an enlarged partly sectional view of the novel main portion of the drawing apparatus of FIG. 3.

In operation, a blank W is first placed on the blank holder 24 as shown in FIG. 3. In this instance, the upper end of the punch 30 is preadjusted so as to be substantially flush with the upper end surface of the blank holder 24 through operation of the punch supporting device 42 which will be later described when description is made to the replacement of the die 12 with a different drawing die. The upper die slide 20 is then caused to come down to a position where the blank W is clamped between the die 28 and the blank holder 24 as shown by the two-dot-chain lines in FIG. 3. The upper die slide 20 remains at that position for a while during which the lower punch slide 22 having passed through the opening 72*a* of the adjusting ram 72 and come in contact with the floating ram 70 further moves upward to its top dead position where it causes the punch 30 to go or protrude into the die 28 for thereby drawing the blank W into a predetermined shape as shown in FIG. 4. Thereafter, the lower punch slide 22 moves downward to its bottom dead position on the way to which it allows the punch 30 and the floating ram 70 to come in contact with the adjusting ram 72 to remain thereat. On the other hand, the upper die slide 20 moves upward to its top dead position together with the die 28. One cycle of drawing operation is thus finished. In the above operation, it is to be noted that since the shock absorbing members 88 and 90 disposed between the floating ram 70 and the adjusting ram 72 and between the floating ram 70 and the lower punch slide 22 eliminate or at least reduce the striking sound and shocks caused thereby, the noise and vibration resulting from the drawing operation can be reduced.

Figure 7:
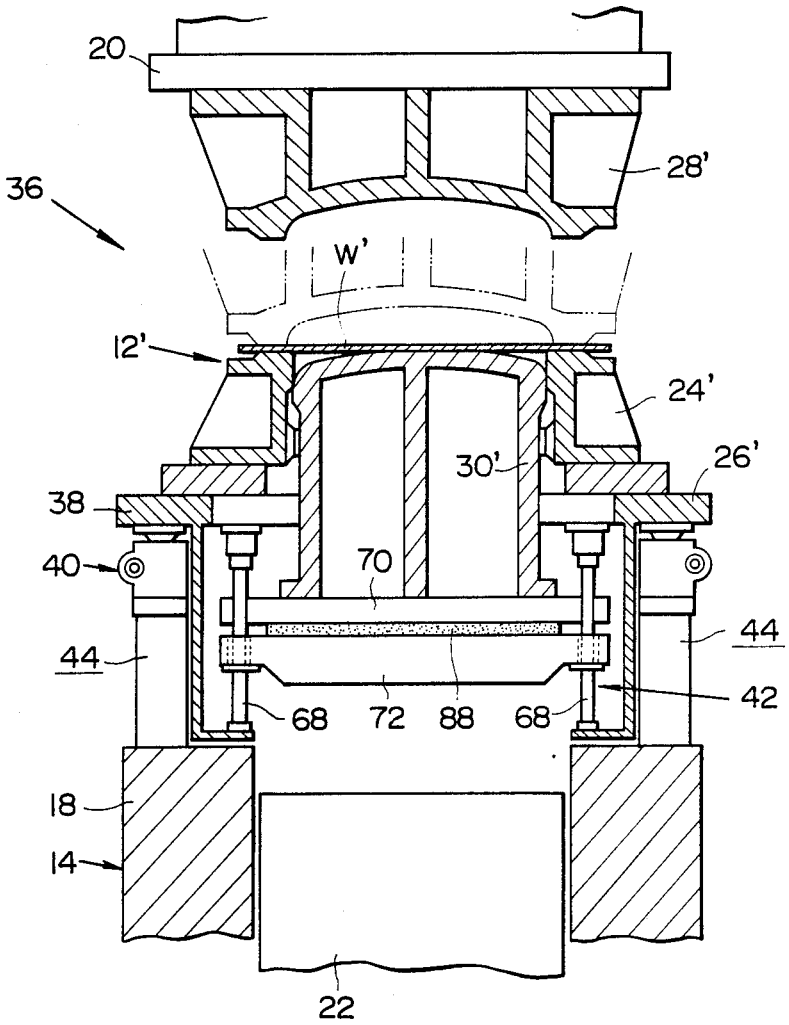
FIG. 7 is a view similar to FIG. 3 but showing a variant according to the present invention.

The drawing die 12 is removed substantially the same way as the prior art except that the punch 30 needs to be detached from the floating ram 70. A different drawing die 12' such as shown in FIG. 7 can be set or mounted in the press 14 in a way basically similar to the prior art except that the punch 30' is attached to the floating ram 70 which is in turn placed on the adjusting ram 72 and that the upper end of the punch 30' is adjusted so as to be substantially flush with the upper end surface of the blank holder 24' by raising or lowering the bottom dead position of the punch 30' through actuation of the electric motor 82 in one or the other rotational direction. More specifically, when the bottom dead position of the punch 30' (i.e. the position where the punch 30' is held on the adjusting ram 72) is to be raised, the electric motor 82 is actuated to rotate in a predetermined rotational direction. Rotation of the motor 82 is transmitted through the reduction gearing 84, the drive shaft 80 and through the connecting shafts 78 to the worm gears 76. The worm gears 76 are thus driven to rotate and cause the threaded posts 68 to rotate, whereby to move the adjusting ram 72 upward. When the bottom dead position of the punch 30' is to be lowered, the electric motor 82 is actuated to rotate in the opposite rotational direction.

The height of the shell or article drawn by the drawing die 12' is adjusted by raising or lowering the top dead position of the lower punch slide 22 through operation of a conventional lower punch slide adjusting mechanism incorporated in the press 14 and/or by raising or lowering the bottom dead position of the upper die slide 20 through operation of a conventional upper die slide adjusting mechanism incorporated in the press 14.

The pressure by which the blank W' is clamped between the die 28' and the blank holder 24' is adjusted by raising or lowering the bolster 38 through actuation of the electric motor 60 in one or the other rotational direction. More specifically, when the bolster 38 is to be raised to increase the pressure, the electric motor 60 is actuated to rotate in a predetermined rotational direction. Rotation of the motor 60 is transmitted through the reduction gearing 62, the drive shaft 58 and through the connecting shafts 56 to the worm gears 52. The worm gears 52 are thus driven which in turn drives the nuts 50, whereby to cause the inner post members 48 to project from the outer post members 46. When the bolster 38 is to be lowered to reduce the pressure, the electric motor 60 is actuated to rotate in the opposite rotational direction.

What is claimed is:

1. In a drawing apparatus having a drawing die assembly and a lower punch slide type double action press, the drawing die assembly having an upper die, a blank holder and a punch, the double action press having an upper die slide mounting thereon the die, a bolster mounting thereon the blank holder and a lower punch slide mounting thereon the punch, said punch being movable upwardly from a bottom dead position through said blank holder to form a blank in cooperation with the upper die, the improvement comprising a power operated punch supporting device adjustably supporting said punch on said bolster when said punch is in its bottom dead position, said device comprising an adjusting ram on which is supported said punch in its bottom dead position and a drive unit through which said adjusting ram is power operated to move upward and downward for changing the bottom dead position of said punch, wherein said adjusting ram is a frame-like member and has an opening allowing said lower punch slide to pass therethrough upon upward movement of same, movement of said adjusting ram to vary the bottom dead position of said punch enabling an upper end of said punch to be substantially flush with an upper end surface of said blank holder, wherein said punch supporting device further comprises a plurality of threaded vertical posts rotatably supported on said bolster, said adjusting ram being formed with a plurality of threaded holes screwed onto said threaded posts and wherein said punch supporting device further comprises a floating ram removably attached to the lower end of said punch and engageable with said lower punch slide upon upward movement of same and also with said adjusting ram when said punch is in its bottom dead position.

2. The improvement in a drawing apparatus as set forth in claim 1, wherein said drive unit comprises a plurality of worm gears respectively engaging said threaded posts to rotate the latter, and an electric motor connected to synchronously drive said worm gears.

3. The improvement in a drawing apparatus as set forth in claim 2, wherein said bolster includes an upper rectangular plate section formed with a rectangular opening for allowing movement of said punch therethrough, a hollow rectangular vertical wall section extending downwardly from the inner periphery of said upper rectangular plate section, and an inward flange section extending horizontally and inwardly from the lower end of said vertical wall section in a manner to allow movement of said lower punch slide therethrough.

4. The improvement in a drawing apparatus as set forth in claim 3, wherein said adjusting ram is rectangular and formed with four of said threaded holes respectively adjacent the corners thereof, and wherein said threaded posts are rotatably mounted at the upper and lower ends thereof on said upper plate section and said inward flange section of said bolster, respectively.

5. The improvement in a drawing apparatus as set forth in claim 4, wherein said adjusting ram has attached thereto a shock absorbing member through which it is brought into contact with said floating ram.

6. The improvement in a drawing apparatus as set forth in claim 5, wherein said floating ram has attached thereto a shock absorbing member through which it is brought into contact with said lower punch slide.

7. The improvement in a drawing apparatus as set forth in claim 6, wherein said double action press further has a bed on which said bolster is mounted.

8. The improvement in a drawing apparatus as set forth in claim 7, further comprising a power operated bolster supporting device adjustably supporting said bolster on said bed, said bolster supporting device comprising a plurality of extensible and contractible post units disposed between said upper plate section of said bolster and said bed to support the former on the latter, and a drive unit through which said post units are power operated to extend and contract for changing the position of said bolster relative to said bed.

9. The improvement in a drawing apparatus as set forth in claim 8, wherein each of said post units comprises a hollow outer post member and an inner threaded post member concentrically joined together such that said inner post member is movable into and out of said outer post member to shorten and lengthen said post unit, each of said post units further comprising a nut and a worm gear, said nut being mounted in said outer post member for rotation but against axial movement and screwed onto said inner post member, said nut having a toothed outer periphery and engaged with said worm gear rotatably mounted in said outer post member so that rotation of said worm gear causes said nut to rotate, which nut in turn causes said inner post member to move axially relative to said outer post member.

10. The improvement in a drawing apparatus as set forth in claim 9, wherein said drive unit comprises an electric motor drivingly connected to said worm gears in such a manner as to be able to synchronously drive same.

* * * * *